US008701683B2

(12) United States Patent
Glenn, Jr. et al.

(10) Patent No.: US 8,701,683 B2
(45) Date of Patent: Apr. 22, 2014

(54) HAIR HIGHLIGHTING APPLICATION TOOL

(75) Inventors: Robert Wayne Glenn, Jr., Liberty Township, OH (US); Paul Edmund Baker, Silchester (GB)

(73) Assignee: The Procter and Gamble Company, Cincinnati, OH (US)

( * ) Notice: Subject to any disclaimer, the term of this patent is extended or adjusted under 35 U.S.C. 154(b) by 1071 days.

(21) Appl. No.: 11/973,484

(22) Filed: Oct. 9, 2007

(65) Prior Publication Data

US 2008/0083418 A1 Apr. 10, 2008

(30) Foreign Application Priority Data

Oct. 9, 2006 (EP) ..... 06021163
Oct. 12, 2006 (EP) ..... 06122215

(51) Int. Cl.
*A45D 24/22* (2006.01)

(52) U.S. Cl.
USPC ..... 132/112

(58) Field of Classification Search
USPC ..... 132/270, 112, 200, 221, 216–217, 320, 132/207; 604/304, 306; 128/112; 15/257.076, 104.93; 401/130, 196, 10
See application file for complete search history.

(56) References Cited

U.S. PATENT DOCUMENTS

| | | | | |
|---|---|---|---|---|
| 2,272,409 A | | 2/1942 | Johnson | |
| 2,310,295 A | | 2/1943 | Keele | |
| 2,776,667 A | | 1/1957 | Fitzgerald | |
| 3,030,968 A | | 2/1960 | Oberstar | |
| 2,962,031 A | | 11/1960 | Bumgarner | |
| 3,662,767 A | | 5/1972 | Murtha | |
| 3,702,508 A | | 11/1972 | Netter | |
| 3,921,647 A | | 11/1975 | Fisher | |
| 4,020,854 A | | 5/1977 | Caruso | |
| 4,398,549 A | | 8/1983 | Thomas | |
| 4,503,870 A | | 3/1985 | Peterson | |
| 4,796,812 A | | 1/1989 | Grollier | |
| 4,830,030 A | * | 5/1989 | Busch et al. | 132/212 |
| 4,942,893 A | * | 7/1990 | Trottier | 132/270 |

(Continued)

FOREIGN PATENT DOCUMENTS

| | | |
|---|---|---|
| DE | 662702 C1 | 7/1938 |
| DE | 197639177 U1 | 4/1977 |

(Continued)

OTHER PUBLICATIONS

U.S. Appl. No. 12/581,476, filed Oct. 19, 2008, Glenn, Jr.

(Continued)

*Primary Examiner* — Todd Manahan
*Assistant Examiner* — Brianne Kalach
(74) *Attorney, Agent, or Firm* — James T. Fondriest

(57) ABSTRACT

Disclosed herein is an application tool (1) and methods to use the same. The application tool (1) comprises two plates (22), connected together. At least one of said two plates (22) comprises a fluid control zone (50), which run along the perimeter edge (30) of said at least one plate (22), a displacement zone (60), which at least partially separate said fluid control zone (50) from a containment zone (70). A hair treatment composition may be loaded onto the containment zone (70). Application of hair treatment compositions through the application tool (1) according to the invention allows for a precise, non-messy and clean targeting of the hair treatment composition on a hair strand and it is especially useful for highlighting and dyeing compositions.

17 Claims, 2 Drawing Sheets

(56) References Cited

U.S. PATENT DOCUMENTS

| | | | | |
|---|---|---|---|---|
| 5,009,652 | A * | 4/1991 | Morgan et al. | 604/385.01 |
| 5,060,679 | A | 10/1991 | Christopher et al. | |
| 5,228,465 | A * | 7/1993 | Hill | 132/212 |
| 5,279,313 | A | 1/1994 | Clausen | |
| 5,535,764 | A | 7/1996 | Abramson | |
| 5,554,197 | A | 9/1996 | Assini | |
| 5,771,906 | A | 6/1998 | De Benedictis | |
| 5,795,344 | A * | 8/1998 | Chappell | 604/379 |
| 5,823,204 | A | 10/1998 | Todd | |
| 5,848,730 | A | 12/1998 | Kawase | |
| 5,961,500 | A * | 10/1999 | Weinstein | 604/304 |
| 5,971,645 | A | 10/1999 | Fukushima | |
| 6,062,231 | A | 5/2000 | De LaForcade | |
| 6,148,829 | A | 11/2000 | De Benedictis | |
| 6,250,312 | B1 | 6/2001 | Dasilva | |
| 6,427,701 | B1 | 8/2002 | Roth | |
| 6,440,175 | B1 | 8/2002 | Stanley | |
| 6,626,599 | B2 | 9/2003 | Delaforcade | |
| 6,746,165 | B2 * | 6/2004 | de Laforcade | 401/10 |
| 6,748,957 | B1 | 6/2004 | Giordano | |
| 7,025,069 | B2 | 4/2006 | Thiebaut | |
| 7,198,049 | B2 | 4/2007 | Elmer | |
| 7,357,137 | B2 | 4/2008 | Husband | |
| 7,425,220 | B2 * | 9/2008 | Barrass et al. | 8/405 |
| 7,475,688 | B2 | 1/2009 | Colacioppo | |
| 7,543,591 | B1 | 6/2009 | Munsil | |
| 2002/0114657 | A1 | 8/2002 | Gueret | |
| 2002/0142027 | A1 | 10/2002 | Gueret | |
| 2003/0007825 | A1 | 1/2003 | De LaForcade | |
| 2004/0016064 | A1 | 1/2004 | Vena | |
| 2004/0031502 | A1 | 2/2004 | Winckels | |
| 2004/0089316 | A1 * | 5/2004 | Hamilton et al. | 132/208 |
| 2004/0182408 | A1 | 9/2004 | De LaForcade | |
| 2005/0079192 | A1 | 4/2005 | Simon | |
| 2005/0207153 | A1 | 9/2005 | Leleve | |
| 2005/0211599 | A1 | 9/2005 | De LaMettrie | |
| 2006/0042643 | A1 | 3/2006 | Delan | |
| 2006/0064824 | A1 | 3/2006 | Godfrey | |
| 2006/0090771 | A1 | 5/2006 | Ramet | |
| 2006/0144415 | A1 | 7/2006 | Magee | |
| 2006/0207036 | A1 | 9/2006 | Kennedy | |
| 2007/0144550 | A1 | 6/2007 | Roher | |
| 2007/0215170 | A1 | 9/2007 | Kennedy | |
| 2007/0227620 | A1 | 10/2007 | Kunii | |
| 2008/0000492 | A1 | 1/2008 | Mills | |
| 2008/0083418 | A1 | 4/2008 | Glenn | |
| 2008/0083419 | A1 | 4/2008 | Glenn | |
| 2008/0083420 | A1 | 4/2008 | Glenn | |
| 2008/0087292 | A1 | 4/2008 | Abergel | |
| 2008/0087293 | A1 | 4/2008 | Glenn | |
| 2008/0087294 | A1 | 4/2008 | Glenn | |
| 2008/0110929 | A1 | 5/2008 | Stanley | |
| 2008/0156817 | A1 | 7/2008 | Roseblade | |
| 2008/0196734 | A1 | 8/2008 | Husband | |
| 2008/0223386 | A1 | 9/2008 | Albisetti | |
| 2008/0223391 | A1 | 9/2008 | Baker | |
| 2008/0223393 | A1 | 9/2008 | Boyle | |
| 2008/0308119 | A1 | 12/2008 | Smith | |
| 2009/0050171 | A1 | 2/2009 | Barrass | |
| 2009/0071496 | A1 | 3/2009 | Glenn | |
| 2009/0084393 | A1 | 4/2009 | Baker | |
| 2009/0084394 | A1 | 4/2009 | Baker | |
| 2009/0084395 | A1 | 4/2009 | Glenn | |
| 2009/0095314 | A1 | 4/2009 | Lund | |
| 2009/0101159 | A1 | 4/2009 | Bonnafous | |
| 2009/0152281 | A1 | 6/2009 | Bowes | |
| 2009/0223531 | A1 | 9/2009 | Lund | |

FOREIGN PATENT DOCUMENTS

| | | | |
|---|---|---|---|
| DE | 198805283 | U1 | 7/1988 |
| DE | 3138389 | C2 | 7/1990 |
| DE | 4041742 | A1 | 6/1992 |
| DE | 29917054 | U1 | 8/2000 |
| DE | 10259016 | A1 | 6/2004 |
| DE | 202004017014 | U1 | 6/2005 |
| DE | 20221665 | U1 | 11/2006 |
| DE | 102005058188 | A1 | 6/2007 |
| DE | 202007016018 | U1 | 4/2008 |
| EP | 1138374 | A1 | 10/2001 |
| EP | 1566114 | A1 | 8/2005 |
| EP | 1264559 | B1 | 11/2005 |
| EP | 1481605 | B1 | 8/2009 |
| FR | 2444421 | A1 | 7/1980 |
| FR | 2495905 | A1 | 6/1982 |
| FR | 2854778 | A1 | 11/2004 |
| FR | 2905833 | A1 | 3/2008 |
| GB | 274875 | A | 10/1927 |
| GB | 2242357 | A | 10/1991 |
| GB | 2383944 | A | 7/2003 |
| GB | 2384425 | A | 7/2003 |
| JP | 4-41305 | | 4/1992 |
| JP | 11-178630 | | 7/1999 |
| JP | 11-178639 | A | 7/1999 |
| JP | 2001-211925 | A | 8/2001 |
| JP | 2002-034636 | A | 2/2002 |
| JP | 2003-199623 | A | 7/2003 |
| JP | 2003-310337 | A | 11/2003 |
| WO | WO 93/02589 | A1 | 2/1993 |
| WO | WO 93/10687 | A1 | 6/1993 |
| WO | WO 98/43511 | A1 | 10/1998 |
| WO | WO 02/074129 | A1 | 9/2002 |
| WO | WO 2006/010354 | A1 | 2/2006 |

OTHER PUBLICATIONS

U.S. Appl. No. 12/622,716, filed Nov. 20, 2009, Smith.
U.S. Appl. No. 12/622,730, filed Nov. 20, 2009, Smith.
U.S. Appl. No. 12/622,762, filed Nov. 20, 2009, Smith.

* cited by examiner

HAIR HIGHLIGHTING APPLICATION TOOL

CROSS REFERENCE TO RELATED APPLICATIONS

This application claims the benefit of U.S. application Ser. No. 11/634,569, filed on Dec. 6, 2006.

FIELD OF THE INVENTION

The present invention relates to an application tool which allows for quick, easy, precise and non-messy targeted application of cosmetic compositions to hair, preferably the application tool according to the invention is especially intended for hair treatment compositions.

BACKGROUND OF THE INVENTION

To accommodate the change in fashion and style and to provide a less drastic masking of the first grey hair than a full head dyeing event, more and more consumers have the desire to highlight their hair.

Although under the term highlighting it is understood to be the selection of hair strands which are lightened at least one shade lighter that the rest of the hair, the results expected by consumers are quite various. To achieve personal customization of the end-look the consumer can choose to perform highlighting by employing home highlighting kits or may visit a professional stylist.

Professionals have a number of devices and techniques at their disposal which together with training and years of experience allow the variety of results expected by the consumers to be delivered. However, due to the accuracy and length of the process, the consumer is required to regularly spend a number of hours at the salon in order to complete the process. Because of the long time and effort employed by the professionals to achieve the expected end results, a high premium is also demanded by the professional stylists for their services.

The home highlighting product market is vast, financially accessible to consumers and offers various products to deliver practically any desired lift of the hair.

However, a number of drawbacks are associated with using home hair highlighting treatments without assistance of a professional. The application of highlighting compositions at the back of the head is difficult to achieve; the selection of the strands requires the user to maintain the arms over the head creating discomfort and tiredness affecting the overall results. Indeed even when the highlighting compositions are applied through an applicator, the use of such an applicator may require considerable practice, patience and experience in order to achieve at least a satisfactory result. These drawbacks are further amplified by the unpleasant nature of highlighting compositions, which can cause bleaching if dripped onto the consumer's home surfaces, skin and clothes.

Some attempts to solve these problems have been contemplated in the art. WO 93/10687 has proposed a highlighting preparation comprising a highlighting agent held by a lining material mounted on a pliable substrate such as an aluminium foil. Once the highlighting agent is activated by addition of hydrogen peroxide, the pliable substrate is folded over a hair strand and the highlighting composition is delivered. US 2003/0024544 discloses a device for applying a dye product to sections of hair, said device comprising a cavity, which can be provided of a fibrous or porous material, and a retention member. The retention member and the cavity are connected but movable relative to each other so that the retention member fits inside the cavity. The hair strand is trapped between the cavity and the retention member to apply the hair treatment composition. JP 200234636 teaches hair-dyeing tongs comprising a head part and a handle part. The head part is composed of two opposite plates to clamp the hair strand. The plates have teeth for dividing and arranging the hair, orifices where the hair treatment composition comes out and sponges, whilst the handle part has a storing compartment for the dyeing composition. Channels run inside the tong from the storing compartment to the plates. JP 2003310337 discloses a hair dyeing utensil comprising a tweezer-shaped tool having at the top end absorbent pads which are in fluid communication with small containers mounted on the arms of tweezers-like tool. When pressure is applied on the side of the tweezers over the small containers, the hair dyeing composition is released and absorbed by the pads at the top ends. GB 2242357 discloses a device comprising two hinged plates covered by an absorbent material impregnated with the hair treatment composition and a closing means. Once a tuft of hair is selected, the plates are closed by the closing means over the hair and left in place. This application device works as a replacement for foils, which are used by stylists in professional salons. JP 2003199623 discloses a sheet brush which can be folded over the hair strands to apply hair treatment composition onto hair strands. The sheet brush is provided with teeth protruding out from the base of the sheet, which can be covered by non-woven fabric. EP 1433399 discloses a device comprising an applicator portion and a fastening mean. The applicator portion comprises a compressible container where the hair treatment composition is lodged. The user positions a hair strand between one finger and the container. Upon application of pressure on the compressible container, the composition contained therein is released on the hair strand. JP 1999178639 discloses a hair cosmetic applicator characterized by two hinged plates, each of these plates has a fitting means on the external surface and a bag comprising a hair treatment composition attached on the internal surface. Each bag contains a hole from which the composition is released through metering layers by opening and closing the hinged plates.

What still remains unsolved by the art is the provision of a hair treatment application tool to satisfy the home highlighting consumers' needs in terms of avoiding the dripping of the highlight composition from the application tool, applying the highlighting composition homogenously over the entire length of the hair strands and easiness to use with one hand, to pick up, grip, hold and lay down. Moreover, the application tool should be easy to guide particularly at the root line and to perform several applications irrespective of the hair length. The application tool must also provide flexibility for creating a high variety of highlights, for inventing new fashions, for shortening the time and costs and for simplifying the highlight performances. Finally, the application tool must be doubtless light, cheap, disposable or recyclable and easy to produce.

It has now been found that an application tool (as defined herein after) can significantly improve the highlighting results at home as well as at professional salons.

SUMMARY OF THE INVENTION

According to the invention, an application tool (1) for hair treatment compositions is provided, comprising a first plate (10) connected to a second plate (20), each of said plates having an internal (101; 201) and an external surface (102; 202); said first (10) and second (20) plates have a perimeter edge (30) characterized in that the internal surface of at least one plate comprises a. a fluid control zone (50), which runs along the perimeter edge (30) of said at least one plate;

b. a displacement zone (60), and c. a containment zone (70);

wherein a material selected from the group consisting of a non-porous compressible material, an absorbent material, an impervious membrane, at least one bristle, at least one tine and combination thereof extends upon at least a portion of said fluid control zone (50); and wherein said fluid control zone (50) and said containment zone (70) are at least partially separated from one another by said displacement zone (60).

The present invention further relates to methods of loading and using said application tool (1) and kit comprising the application tool (1) disclosed herein.

DETAILED DESCRIPTION OF THE INVENTION

Figure 1:
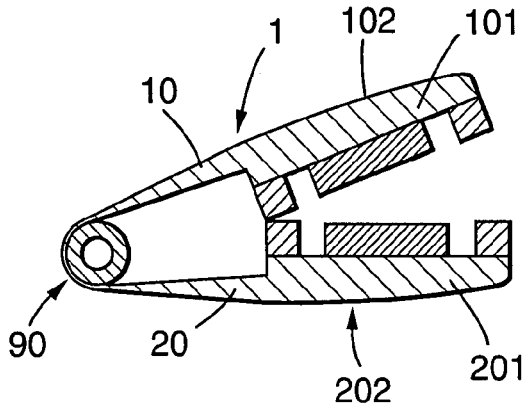
FIG. 1 is a cross sectional view of an embodiment of the application tool (1) according to the invention comprising first (10) and second (20) plates, connected via a hinge (90); one plate (10) being the mirror image of the other (20). Each of said first and second plate (10; 20) comprises an internal (101; 201) and an external (102; 202) surface.

It has been surprisingly found that the application tool (1) described herein allows to solve the above mentioned technical problem. The selection of two connected plates (10; 20) allows the user to guide the application tool (1), with the use of either hand, precisely and easily also to difficultly accessible sectors such as at the back of the head or at the root of the hair close to the scalp. The fluid control zone (50), which run along the perimeter edge (30) of the internal surface (101; 201) of at least one plate (10; 20) and the material which extends there upon, provide the application tool (1) with an excellent means to prevent dripping of the hair treatment composition from the application tool (1) and helps to reduce excessive deposition of hair treatment composition during application onto the hair. The containment zone (70) is the zone where the hair treatment composition is applied and jointly with the displacement zone (60) allows the delivery of a hair treatment composition to the selected hair strand in a homogeneous and clean fashion.

For the purpose of this invention, the term hair refers to both living hair i.e. on a living body and to non-living hair i.e. in a wig, hairpiece or other aggregation of non-living keratinous fibre. Mammalian, preferably human hair is intended. However, wool, fur and other keratinous fibre may be suitable to be used with the application tool according to the invention.

The term hair strand, for the purpose of this invention, refers to at least two keratinous fibres, especially hair, in particular human hair and it should be construed as hair bundle.

As used herein, the term "applied" when referring to a hair treatment composition is to encompass coated, loaded, absorbed, adsorbed and adhered.

While the specification concludes with claims, which particularly point out and distinctly claim the invention, it is believed the present invention will be better understood from the following description.

1. Plates

Figure 2:
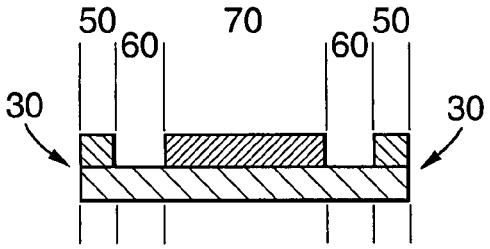
FIG. 2 is a cross sectional view of one plate (10) of the embodiment shown in FIG. 1, displaying the arrangement of the fluid control zone (50), which runs along the perimeter edge (30) of said one plate (10), of the displacement zone (60) and containment zone (70).

The application tool (1) of the present invention comprises a first (10) and a second (20) plate; both plates (10; 20) are of ergonomic size and can thus fit easily on either hand. The shape of the plates may vary. Rectangular, square, circular, elliptical or oblong shapes may be useful as they are easy to manufacture but other shapes, particularly those that are easily recognized by the consumers may be used. It is unimportant which plate is designated as a first plate and which is designated as a second plate. As shown in FIGS. 1 and 2, each plate (10; 20) comprises an internal (101; 201) and external surface (102; 202). The internal surface (101; 201) of at least one plate (10; 20), preferably both plates, comprises a fluid control zone (50), a displacement zone (60) and a containment zone (70) as described hereinafter.

Figure 7:
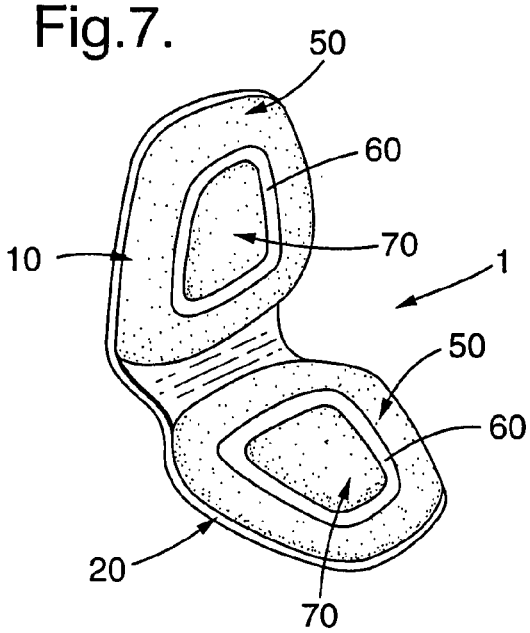
FIG. 7 is a perspective view of an application tool (1) according to the invention. The first plate (10) and the second plate (20) are mirror images. The displacement zone (60) entirely separates the containment zone (70) from the fluid control zone (50). An absorbent material extends upon both the containment zone (70) and the fluid control zone (50).

Each plate may be independently flat or curved. Each plate may have a cavity or a groove and said cavity or grove may be independently located on the internal (101; 201) or external (102; 202) surface of each plate (10; 20). Each plate may be of the same or different size and shape. Preferably, the first plate is the mirror image of the second plate (10; 20) for easy manufacture as shown in FIGS. 1 and 7.

Each plate may have a surface area of from about 2 $cm^2$ to about 70 $cm^2$, preferably from about 3 $cm^2$ to about 50 $cm^2$, more preferably from about 4 $cm^2$ to about 30 $cm^2$.

Each plate may be independently manufactured from any known material or combination of materials capable of supporting a hair treatment composition. Suitable materials are polymer resins such as a polyolefin e.g. polypropylene, polyethylene or polyethylene terephthalate. Other polymers which could be used include polyvinylchloride, polyamide, acetyl, acrylonitrile butadiene styrene, acrylic, acrylonitrile styrene acrylate, ethylene vinyl alcohol, polycarbonate, polystyrene, silicone or thermo plastic elastomer, thermo plastic vulcanate or copolymers where appropriate; flexible pliable substrates such as paper boards, metal based substrates and aluminium foils, filmic substrates or multiple laminations or combinations of multiple layers of said materials.

The method of manufacture of the plates may include, but is not limited to, injection moulding, co-injection moulding, over moulding, in-mold assembly, compression moulding, blow moulding, thermo or vacuum forming of a blister type shell and lamination onto a carrier plastic or board material in the horizontal or vertical plane.

2. Plates Connection

The selection of two connected plates improves the user's perception of control over the application tool (1) and allows the user to guide the application tool (1), with the use of either hand, precisely and easily and also allows access to troublesome sections such as the back of the head or the root of the hair close to the scalp. In addition, the plates' connection allows the user to move the application tool (1) from one hair strand to another without having to adjust the position of one plate (10) onto the other (20) after each application.

The connection between the plates (10; 20) according to the present invention allows the application tool (1) to be in a closed state or in an open state. When the application tool (1) is in a closed state, said first plate (10) is in a juxtaposed relationship to said second plate (20), whereas when the application tool (1) is in an open state said first plate (10) is distant from the said second plate (20). When the application tool is in an open state, the angle between said internal surfaces (101; 201) of said first and second plates (10; 20) may range from about 5° to about 360°, preferably from about 30° to about 185°, more preferably at least about 50°. The connection between said first (10) and second (20) plates is preferably of resilient nature. In certain embodiments the application tool (1) may be in an open state and said first (10) and second plates (20) may be brought together into a juxtaposed relationship by applying pressure on their external surfaces (102; 202). In certain embodiments the application tool (1) may be in a closed state and pressure has to be applied on to the connection to distance the internal surfaces (101; 201) of the first (10) and the second plate (20). In certain other embodiments, the application tool (1) is in a closed state and each plate is provided with fastening means where the thumb and index finger may be positioned to assist the separation of the first and second plates (10, 20). Independently from their initial orientation, both the first (10) and the second (20) plates, by pivoting about the connection, may re-establish their initial orientation by springing back. The characteristics of the connection may be an intrinsic property of the material used to manufacture the connection or may be provided by the design of the connection itself. The connection should not break or get damaged so as to affect utility within a few applications. The connection should not be too resistant to the applied pressure by the user, otherwise the user's hand and fingers may ache during repetitive use. On the other end, the connection should not be too loose or else there is no perception of guidance over the application tool (1). The spring back property should be effective otherwise said plates (10; 20) may remain always either in a juxtaposed relationship or distant. However, the spring back should not occur uncontrollably and unexpectedly as it may otherwise cause tearing of the material comprised in said fluid control (50) and containment zones (70), or may injure the user's hand and fingers or may displace inadvertently the hair treatment composition from the application tool (1). The present inventors have surprisingly found that the connection should work with applicable pressures ranging from about 0.01 N/cm$^2$ to about 30.0 N/cm$^2$, more preferably from about 0.01 N/cm$^2$ to about 15.0 N/cm$^2$, even more preferably from about 0.01 N/cm$^2$ to about 10.0 N/cm$^2$ and that the connection should have a spring back pressure to open ranging from about 0.01 N/cm$^2$ to about 30.0 N/cm$^2$, more preferably from about 0.01 N/cm$^2$ to about 15.0 N/cm$^2$ and even more preferably from about 0.01 N/cm$^2$ to about 10.0 N/cm$^2$.

The first (10) and the second (20) plates are connected via any suitable means that fulfils the above described requirements, including the user's hand through the thumb and the index finger; preferably, said first (10) and second (20) plates are connected via a hinge (90). The hinge (90) can be formed in a number of ways including: a "live" injection moulded hinge, a co-injected hinge, an over moulded hinge, in-mold assembly, a leaf spring or any other appropriate spring assembly, a strap hinge, a fold formed by a kiss-cut, score or crease.

In certain embodiments both the first (10) and the second (20) plates have a female part of the hinge (90) incorporated in their design. The female part of the hinge (90) is created during the manufacture process for the first and second plate (10; 20), for example during the injection moulding process. A pin is designed to fit both female parts of the hinge (90) created on the first (10) and second plates (20). The pin, preferably of rectangular shape is manufactured from a polymer resin such as polyolefin, preferably polypropylene. The pin is assembled into the female parts of the plates (10; 20) to create the hinge (90).

In certain embodiments, both the first (10) and second (20) plates may be manufactured within the same injection mould for example from polypropylene. A living hinge (90) also made from polypropylene may be created between the first (10) and the second (20) plate. Polypropylene may be used to provide a living hinge that can be flexed multiple tines without breakage. The living hinge is typically closed during the de-moulding process.

In certain embodiments, both the first (10) and second (20) plates may be manufactured within the same injection mould for example from polypropylene and a hinge (90) can be created by co-injection, in-mold assembly or over-moulding of a thermo plastic elastomer or a thermo plastic vulcanate or any other material that can be used to provide a hinge (90) with the properties listed above.

3. Zones

The fluid control zone (50) runs along the perimeter edge (30) of the internal surface (101; 201) of at least one plate (10). The fluid control zone provides the application tool (1) with an excellent measure to avoid messiness during the application of a hair treatment composition, preventing the formation of blobbing which results in the deposition of an excessive amount of hair treatment composition onto the hair, especially close to the roots. Such blobs of hair treatment composition may also drip across other hair strands causing unacceptable and unsightly treatment in neighbouring strands or ooze outside the application tool (1).

The fluid control zone (50) may have a length of from about 1 cm to about 80 cm, preferably from about 3 cm to about 50 cm and more preferably from about 6 cm to about 30 cm. The fluid control zone (50) may be of constant or variable width. The fluid control zone may be continuous or discontinuous; by continuous it is meant that the material present in the fluid control zone (50) does not form loci or islets or it is not interrupted or stopped by the displacement zone (60). Preferably the fluid control zone (50) of at least one plate (10), more preferably of both plates (10; 20) is continuous as shown FIG. 7. When the fluid control zone (50) is continuous, said fluid control zone (50) has a width of from about 0.05 cm to about 4.00 cm, preferably from about 0.10 cm to about 3.00 cm, more preferably from about 0.50 cm to about 2.50 cm.

When the fluid control zone (50) is discontinuous said fluid control zone (50) has a width of from about 0.00 cm to about 4.00 cm, preferably from about 0.00 cm to about 3.00 cm, more preferably from about 0.00 cm to about 2.50 cm, wherein the fluid control zone (50) has a width of about 0.00 cm where the fluid control zone (50) is absent. When the fluid control zone (50) is discontinuous, at least some portion has a width of at least 0.05 cm, preferably at least 0.10 cm, more preferably at least 0.50 cm.

The fluid control zone (50) is at least partially separated from the containment zone (70) by the displacement zone (60). By partially separated is meant that at least one portion of the displacement zone (60) separates the fluid control zone (50) from the containment zone (70). By separation is meant that there is a void volume of displacement zone (60) between the fluid control zone (50) and the containment zone (70) on the internal surface (101) of said plate (10) when the plates (10; 20) are into juxtaposed relationship. Preferably, the fluid control zone (50) is entirely separated from the containment zone (70) by the displacement zone (60). The displacement zone (60) allows the hair treatment composition to be displaced from the containment zone (70) to the fluid control zone (50) when the plates (10; 20) are brought into juxtaposed relationship.

The displacement zone (60) may be of constant or variable width. The displacement zone (60) may have a width of from about 0.05 cm to about 4.00 cm, preferably from about 0.10 cm to about 3.00 cm, more preferably from about 0.30 cm to about 2.50 cm. When the fluid control zone (50) is only partially separated from the containment zone (70), at least a portion of the displacement zone (60) has a width of at least about 0.05 cm, preferably at least about 0.10 cm, more preferably at least about 0.30 cm.

When the application tool (1) is in the closed state and the plates (10; 20) are in a juxtaposed relationship, the hair treatment composition is forced to move from the containment zone (70) to the displacement zone (60) toward the fluid control zone (50). Given the presence of the fluid control zone (50) and of the displacement zone (60), the hair treatment composition does not leak or ooze beyond the perimeter edge (30) of the plates (10; 20) but stays within the application tool (1).

A material selected from the group consisting of an absorbent material, a non-porous compressible material, at least one bristle, at least one tine, an impervious membrane and combination thereof extends upon at least a portion of said fluid control zone (50), preferably upon at least a portion of said fluid control zone (50) and upon at least a portion of said containment zone (70).

Suitable absorbent materials for use in the present invention may be selected from non-wovens; wovens; porous foams and foam materials; porous plastics; flexible frits; meshes; sponges and combinations thereof including recycled and composite materials having one or more plies of the same or different materials superimposed physically, joined together continuously (laminated), in a discontinuous pattern, or by bonding the external edges at discrete loci provided that the structures meet the functional requirements described hereinabove.

The absorbent materials of the present invention may be selected from non-wovens and/or porous foams. Non-woven materials are produced from fibres that may be staple or continuous filaments or be formed in situ and include a manufactured sheet, web or batt or directionally or randomly oriented fibres, bonded by friction, and/or cohesion and/or adhesion. Nonwoven webs and processes for making them may comprise three steps: fiber laying, precursor web formation, and fiber bonding. The fibre laying step may be comprised of the spunlaying, meltblowing, carding, airlaying, wetlaying and combinations thereof, of the fibres comprising the web onto a forming surface. The step of precursor web formation may prevent the fibres comprising the web from coming apart during the bonding step. Precursor web formation may be performed via a pre-bonding step, such as one that is chemical or mechanical in nature. The bonding step may then impart strength to the finished web. The bonding step may be comprised of subjecting the fibres comprising the web to hydroentanglement (HET), cold calendering, hot calendering, air through bonding, chemical bonding, needle punching, and combinations thereof. Suitable non-woven materials may be comprised of natural or synthetic fibres selected from acetate fibres; acrylic fibres; cellulose ester fibres; modacrylic fibres; polyamide fibres; polyester fibres; polyolefin fibres; polyvinyl alcohol fibres; rayon fibres; keratin fibres; cellulose fibres; silk fibres and combinations thereof. The non-wovens may be comprised of mono-component fibres, such as a polyolefin or polyester, or bi-component fibres, such as a sheath/core fibre or side by side fibre of polyethylene/polypropylene or polyethylene/polyester, or bi-constituent fibres comprised by a blend of two or more thermoplastic polymers.

Porous foams and foam materials are made from low density elastomers, plastics, and other materials with various porosities and may be selected from open cellular foams; flexible foams; rigid foams; and reticular foams and syntactic foams which can be fabricated into finished shapes using molding, casting, extrusion, pultrusion, machining, thermal forming, plastic welding, blow molding, rapid prototyping techniques, grinding and/or other specialized processes. The porous foams and foam materials may be composed of a variety of chemical systems including acrylonitrile-butadiene-styrene; acrylics; epoxy resins; fluoropolymers; isoprene-styrene and styrene-butadiene-styrene; synthetic rubbers or elastomers based on a variety of systems such as silicone, polyurethane and neoprene; nitrile rubbers; plastics or elastomers formed from natural or plant-based raw materials such as natural rubber (polyisoprene) or vulcanized fibre; water-based and water-borne resins and latex materials. Chemical systems for porous foams and foam materials may include ethylene copolymer, expanded polyethylene, polycarbonate, polyester, polyether, polyetherimide, polyimide, polyolefin, polypropylene, polyurethane, phenolic, polyurea, and vinyl.

Porous plastics can be made from wide variety of materials including polytetrafluoroethylene, polyethylene, polypropylene, and polyvinyldifluoride. They are created by filling a mold with tiny plastic pellets, subjecting the mold to heat and pressure so the pellets bond where they touch. This part is then heated outside the mold; the part shrinks significantly during this step which strengthens it.

The porous foams are preferably polyurethane foams. Suitable examples of porous foams are available from Recticel International (Belgium).

Useful non-porous compressible material comprises materials such as polyethylene, polypropylene or silicone or natural and synthetic rubbers, thermo plastic elastomer, thermo plastic vulcanate or copolymers. Suitable thermoplastic materials include polyolefins (including polyethylenes, such as high density polyethylene and polypropylene), polyvinylidene chloride, and polystyrene. Suitable examples include, but are not limited to, ethylene-propylene diene monomer rubbers such as Santoprene® sold by Monsanto, Inc. of St. Louis, Mo.; halogenated polyolefins such as Alcryn sold by DuPont Polymer Products of Wilmington, Del.; hydrogenated adduct of a styrene-butadiene block copolymer with maleic anhydride, such as Craton sold by Shell Chemical Company of Houston, Tex.; SEBS (sequenced styrene-ethylene-butadiene) polymers. Other materials could be used including polyvinylchloride, polyamide, acetyl, acrylonitrile butadiene styrene, acrylic, acrylonitrile styrene acrylate, Ethylene vinyl alcohol, polycarbonate and polystyrene.

Suitable materials for a bristle are synthetic material such as polyethylene, polypropylene or polyethylene terephthalate, silicone or natural and synthetic rubbers, thermo plastic elastomer, thermo plastic vulcanate or copolymers. Other materials could be used including polyvinylchloride, polyamide, acetyl, acrylonitrile butadiene styrene, acrylic, acrylonitrile styrene acrylate, ethylene vinyl alcohol, polycarbonate, polystyrene, or copolymers or non-woven or foam structures or natural sources such as Horse Hair. The wire form of the bristles or brushes may be straight, curved or crimped to achieve the required performance.

Suitable materials for at least a tine include polyethylene, polypropylene or polyethylene terephthalate, silicone or natural and synthetic rubbers, thermo plastic elastomer, thermo plastic vulcanate or copolymers. Other materials could be used including polyvinylchloride, polyamide, acetyl, acrylonitrile butadiene styrene, acrylic, acrylonitrile styrene acrylate, ethylene vinyl alcohol, polycarbonate, polystyrene, or copolymers or electro-static flocking or non-woven or foam structures.

Suitable materials for an impervious membrane include polyethylene, polypropylene or polyethylene terephthalate, silicone or natural and synthetic rubbers, thermo plastic elastomer, thermo plastic vulcanate or copolymers. Other materials could be used including polyvinylchloride, polyamide, acetyl, acrylonitrile butadiene styrene, acrylic, acrylonitrile styrene acrylate, ethylene vinyl alcohol, polycarbonate, polystyrene, or copolymers.

The materials which extend upon at least a portion of said fluid control zone (50) can be manufactured in a number on ways including: co-injected, over moulding, in-mold assembly, adhesion lamination, heat bonding and may be removable or permanently joined to fluid control zone. Any methods suitable to join the material to the fluid control zone (50) to the application tool (1) may be employed herein provided that said method does not destroy or alter the performance of said material. Useful methods are, but not limited to, heat welding including pressure, ultrasonic forces, radio or high frequencies, co-extruded heat activated adhesives, electro static adhesions such as flocking by fibres. The material may also be joined to the application tool (1) through adhesive, including two-side tape, thermo-set, hot melt and cold seal, adhesion or extrusion lamination. Mechanical interlock or entanglement such as Velcro®, clamping, snap locks, sealing beads, locking pins and magnetism may also be used to adhere the material to the application tool (1).

The materials described above to extend upon at least a portion of said fluid control zone (50) and the methods to join said material to the internal surface (101, 201) of said at least one plate (10) may be employed also for said d material which extends upon at least a portion of said containment zone (70).

In addition, the containment zone (70) may also be an area of said internal surface (101; 201) of said at least one plate (10) having visual and/or tactile differences, such as a coloured or shaded area, an area with pattern or marking or an embossed area. The containment zone (70) may further be a groove in said at least one plate (10) or it may be a cavity of said at least one plate (10).

Figure 4A:
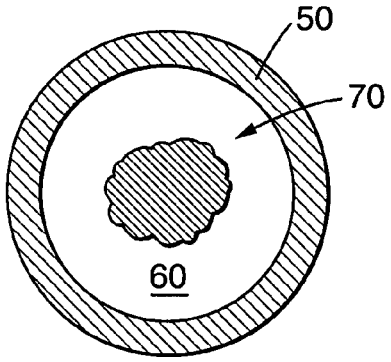
FIG. 4*a* is a top view of one plate of an embodiment of the application tool (1) according to the invention, wherein an absorbent material or a non-porous compressible material extend upon the fluid control zone (50) and the containment zone (70) comprises an area, which has a visible difference from the displacement zone (60). The non-coloured or non-shaded region of the plate (10) is the displacement zone (60).
Figure 4B:
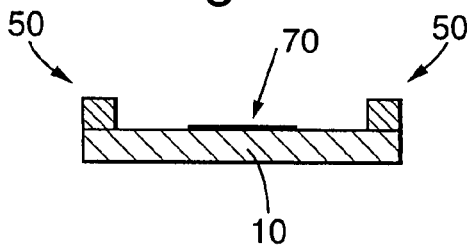
FIG. 4*b* is a cross sectional view of the plate (10) shown in FIG. 4*a*.
Figure 5:
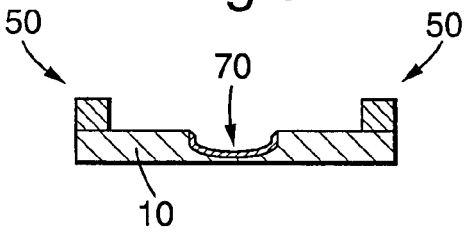
FIG. 5 is a cross sectional view of one plate (10) of an embodiment of the application tool (1) according to the invention, wherein an absorbent material or a non-porous compressible material extend upon said fluid control zone (50) and wherein said containment zone (70) comprises a groove in said at least one plate (10).

In one preferred embodiment of the application tool (1) according to the invention, a non-porous compressible material extends upon the fluid control zone (50) of at least one plate (10). Preferably, when a non-porous compressible material extends upon the fluid control zone (50), said fluid control zone (50) is continuous. More preferably, when a non-porous compressible material extends upon the fluid control zone (50), an absorbent material as shown in FIG. 1 extends upon the containment zone (70) of said at least one plate (10) or said containment zone (70) is an area of the internal surface (101) having visible or tactile differences such as a coloured or shaded area, in area with a pattern or markings or an embossed area as shown in FIGS. 4*a* and 4*b*. In another embodiment said containment zone (70) is a groove in said at least one plate (10) as shown in FIG. 5.

In one embodiment of the application tool (1) of the present invention an absorbent material extends upon the fluid control zone (50) and the containment zone (70) of said first (10) and second (20) plates as shown in FIG. 7. In another embodiment, a non-porous compressible material extends upon said fluid control zone (50) of one plate (10) and a plurality of tines (71) extends upon said containment zone (70). In another embodiment a plurality of tines (71) extends upon the containment zone (70) of one plate and an absorbent material extends upon the fluid zone (50) and the containment zone (70) may vary. The tines may extend upon the containment zone (70) randomly as shown in FIG. 3*c*. Combinations of these elements are also contemplated within the scope of the present invention so as to have i.e. a containment zone (70) which is as a groove in said at least one plate (10) and tines or bristles may extend upon the perimeter of said groove and around said groove.

Within the scope of the present invention are also included embodiments of the application tool (1) comprising combinations of said first (10) and second (20) plate, combination of materials which extend upon said zones.

4. Additional Features 4.1 Reservoirs

Figure 6:
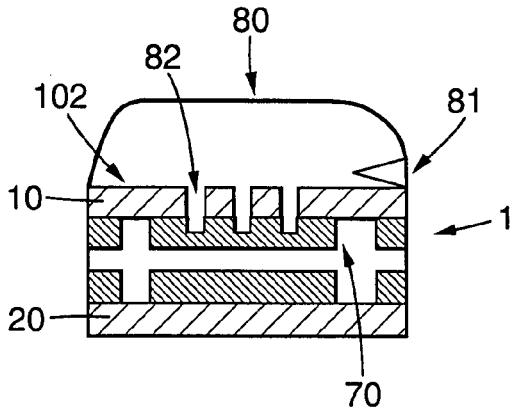
FIG. 6 is a cross sectional view of an embodiment of the application tool (1) according to the invention wherein one plate (10) comprises a reservoir (80) adapted on the external surface (102) of one plate (10). The reservoir (80) is provided with a valve (81) to load a hair treatment composition into said reservoir (80), wherein said reservoir (80) is in fluid communication with the containment zone (70) through apertures (82) present on the plate (10).

The application tool (1) may further comprise a reservoir (80) for a hair treatment composition, wherein said reservoir (80) communicates with said fluid control zone (50), displacement zone (60) and/or containment zone (70). The reservoir (80) may be present on the external surface (102; 202) or internal surface (101, 201) of one or both plates. Preferably, the reservoir (80) communicates with said zones (50; 60; 70) in the internal surface (101; 201) through apertures (82) located through said plates (10; 20). One non limiting example is shown in FIG. 6, wherein both plates (10; 20) comprise an absorbent material which extend upon the fluid control zones (50) and the containment zones (70) and a reservoir located on the external surface (102) of the first plate (10) and apertures (82) through said first plate (10) set in communication the reservoir (80) with the absorbent material which extends upon the containment zone (70). In this particular embodiment a valve (81) is located on the reservoir (80). In some embodiments, a one-way or a two-way valve (81) may be incorporated into the plates (10; 20) and/or in the reservoir (80) to allow loading of the hair treatment composition by engagement of a bottle, tube, syringe, bag, sachet or any container suitable for dispensing the hair treatment composition such as a nozzle, a syringe, an actuator or similar dispensing devices. The reservoir (80) may be fixed, attachable or removable from the plates (10; 20) and may be disposed of once the hair treatment compositions have been released.

The reservoir (80) comprises materials such as polyethylene, polypropylene, polyethylene terephthalate, polyvinylchloride, silicone or natural and synthetic rubbers, thermo plastic elastomer, thermo plastic vulcanate or copolymers. The reservoir can be formed in a number of ways including:

co-injected, over moulding, in-mold assembly, vacuum forming, casting, adhesion lamination, or heat bonding of a laminate material.

The apertures (82) may be covered by metering layers, barriers materials or liners removable via peeling, rupturing, puncturing, breaking, tearing, piercing, sliding, folding, and compression. The release liner or barrier may be peelable and/or resealable and may be constructed from a plastic, aluminium laminate constructions. Some examples of these materials include: laminates of low density polyethylene or blends of polyethylene with poly-isobutylene with aluminium foil and polyethylene terephthalate or bi-orientated polypropylene peel-able foils and may be made of a gas resistant material, especially for hair treatment composition comprising hydrogen peroxide, including aluminium laminated foil, metalised aluminium onto a plastic carrier, Aclar® polychloro-trifluoroethylene, polyvinylidene chloride, ethylene-vinyl alcohol copolymer, silica and aluminium oxides.

4.2 Stop Mechanism

A stop mechanism may be incorporated onto at least one of the internal surfaces (101; 201) of said first and second plate (10; 20). The stop mechanism ensures that the hair treatment composition may not be forced beyond the perimeter edge (30) of said plates (10; 20) and may act in collaboration with the fluid control zone (50). In certain embodiments, the application tool (1) is brought into a closed state by applying pressure on the external surfaces (102; 202) of the plates (10; 20). When a too high pressure in moving the plates (10; 20) into a juxtaposed relationship is exerted, the hair treatment composition may drip out of the application tool or it may form blobs leading to unacceptable mess. Too high pressure may even cause damage of the material comprised in the zones (50; 70) affecting the application of the hair treatment composition to the hair strand.

In certain embodiments, the stop mechanism may be manufactured during the same manufacturing step as the plates and with the same or different material.

The presence, size and height of the stop mechanism are related to the compressibility of the materials which extend upon the containment zone (70) and the fluid control zone (50). In certain other embodiments the stop mechanism may be one or more tines or it may comprise teeth of a comb-like structure in any of the material described herein before. In certain embodiments the stop mechanism may be positioned upon the displacement zone (60) and it may be shorter than the height of the material which extends upon the containment zone (70) if present and/or upon the fluid control zone (50). In certain other embodiments, the stop mechanism may be incorporated at the perimeter edge (30) of the first (10) and/or second (20) plate or in proximity of the connection on the internal surface (101; 201). In other embodiments the stop mechanism may be an upward extension of the plate at the perimeter edge (30) or may be integrated within the hinge (90).

4.3 Hair Strand Selection Means

Consumers may use their fingers to select the hair strands on which they desire to apply the hair treatment composition. The application tool (1) of the present invention may however be further provided with hair strand selection means. Examples of hair strand selection means are, but not limited to, spikes, hooks, crochets, clips or beads. The hair strand selection means may be incorporated in one or both plates (10; 20). Said means may also be attached through a snap mechanism to the plates (10; 20) such that the hair strand selection means may swing from a position proximal to the plate to a far one, such as it happens with the blades of a penknife. The hair strand selection means may also be separately provided to the application tool (1) of the present invention as a component of a kit as described herein below.

4.4 Gripping Areas

Usually consumers wear gloves during the application of the hair treatment composition. The gloves are typically made from materials such as poly vinyl chloride or polyethylene or rubber materials such as isoprene, nyoprene or latex and may increase the difficulty for the consumers to grip the application tool (1). Thus, the application tool (1) disclosed herein may further comprise on the external surfaces (102; 202) of one or both plates (10; 20) gripping areas that are designed to provide grip. These gripping areas may be manufactured using co-injection or over-moulding techniques when the plates are manufactured. Useful materials include, but are not limited to, materials such as polyethylene, polypropylene or silicone or natural and synthetic rubbers, thermo plastic elastomer, thermo plastic vulcanate or copolymers. Other materials could be used including polyvinylchloride, polyamide, acetyl, acrylonitrile butadiene styrene, acrylic, acrylonitrile styrene acrylate, ethylene vinyl alcohol, polycarbonate and polystyrene, or electro-static flocking or sealed non-woven or foam structures. In addition, the gripping areas may be formed through embossing, debossing or coating of the external surfaces (102; 202) of one or both plates (10; 20) or it may be a cavity present on the external surface (102; 202) of said plates (10; 20) The gripping means can be located in only a portion of the external surface (102; 202) or they may cover the whole external surfaces (102; 202).

4.5 Release Liner or Barrier

Release liners or barriers may be present to protect the fluid control zone (50), the displacement zone (60) and/or the containment zone (70) and the materials which extend there upon from contamination. The release liner or barrier may be peelable or resealable and may be constructed from a plastic, aluminium laminate constructions. Some examples of these materials include: laminates of low density polyethylene or blends of polyethylene with poly-isobutylene with aluminium foil and polyethylene terephthalate or bi-orientated polypropylene peel-able foils and may be made of a gas resistant material, especially for hair treatment composition comprising hydrogen peroxide, including aluminium laminated foil, metalised aluminium onto a plastic carrier, Aclar® polychloro-trifluoroethylene, polyvinylidene chloride, ethylene-vinyl alcohol copolymer, silica and aluminium oxides.

4.6 Means to Perform Loading of the Hair Treatment Composition into the Application Tool One or more means suitable to attach, adapt or install a dispensing or loading device to perform the loading of the hair treatment composition onto the containment zone (70) of the application tool (1) according to the invention may be present. Examples of said means are, but not limited to, nozzles and orifices, pouch pocket or one-way or two-way valves (81) present on at least one plate (10) or through the connection. Said means may be permanently connected to the application tool (1) or may be removable, they may be disposable or recyclable and they may be provided as a separate component of a kit as described herein below.

5. Hair Treatment Compositions and Loading Thereof

Accordingly, the application tool (1) may preferably be loaded with hair treatment compositions comprising components known, conventionally used, or otherwise effective for use in oxidative bleaching and or hair coloring. The compositions may comprise components known, conventionally used, or otherwise effective for use in hair treatment compositions particularly oxidative bleaching and dye compositions which include but are not limited to: developer dye compounds; coupler dye compounds; direct dyes; oxidizing agents; thickeners; chelants; pH modifiers and buffering agents; alkalising agents, carbonate ion sources and radical scavenger systems for example glycine; anionic, cationic, nonionic, amphoteric or zwitterionic surfactants, or mixtures thereof; persulfates, silicates, hydrogen peroxide, anionic, cationic, nonionic, amphoteric or zwitterionic polymers, hydrophobically modified polymers or mixtures thereof; fragrances; dispersing agents; solvents, peroxide stabilizing agents; chelants for example ethylenediaminedisuccinic acid, humectants, proteins and derivatives thereof, plant materials (e.g. aloe, chamomile and henna extracts); silicones (volatile or non-volatile, modified or non-modified) for example amodimethicone, film-forming agents, cellulose polymers and their derivatives, ceramides, preserving agents, gel networks, colour indicators and opacifiers. Some adjuvants which are suitable are listed in the International Cosmetics Ingredient Dictionary and Handbook, (8th ed.; The Cosmetics, Toiletry, and Fragrance Association). Particularly, vol. 2, sections 3 (Chemical Classes) and 4 (Functions) are useful in identifying specific adjuvants to achieve a particular purpose or multipurpose. A representative but not exhaustive list of polymers and thickening agents can be found in "The Encyclopaedia of Polymers and Thickeners for Cosmetics" compiled and edited by Robert Y. Lochhead, PhD and William R. Fron, Department of Polymer Science, University of Southern Mississippi.

The hair treatment composition may be loaded into the application tool (1) by any means. The hair treatment compositions are preferably applied onto the containment zone (70) but it may also be applied onto the displacement (60) and onto the fluid control zones (50). Preferably, at least one hair treatment composition is loaded onto the containment zone (70) of at least one plate (10), more preferably on the material which extends there upon. In embodiments of the application tool (1) comprising a reservoir (80), at least one hair treatment composition may be loaded onto the reservoir (80). In certain embodiments of the present invention, one hair treatment composition is loaded onto one of the zone (50; 60; 70), preferably the containment zone (70), and into the reservoir (80) if present.

The hair treatment composition may be applied for example with a spatula, by a squeezable tube or by a dispensing bottle. In embodiments where the application tool (1) is provided of means to perform loading as described above, the loading can be performed by attaching or adapting the application tool (1) itself or parts of the application tool (1) to external loading devices such as squeezable tube, a bottle or a syringe or by any other suitable dispenser as described above. When the hair treatment compositions require mixing and activation prior application to the hair, the single component may be mixed by shaking or stirring before loading or can be mixed during the loading procedure by employing specialized two or multi-chambered containers coupled with a static mixer. The mixing may also be performed by interposing an additional mean capable of mixing two or more hair treatment compositions or capable of mixing powders with water or other solvents to make a hair treatment composition. Said interposed mean can also be provided with features to inject or load the mixed hair treatment compositions onto the application tool (1).

The hair treatment compositions may be applied onto the application tool (1) by pressure or by vacuum. The hair treatment compositions may be applied during different time periods, one after the other or after application on the hair of a first hair treatment composition.

Figure 3A:
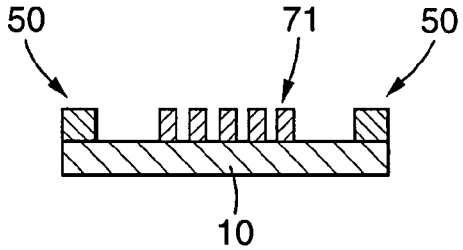
FIG. 3*a* is a cross sectional view of one plate (10) of an embodiment of the application tool (1) according to the invention, wherein an absorbent material or a non-porous compressible material extend upon the fluid control zone (50) and tines or bristles (71) extend upon the containment zone.
Figure 3B:
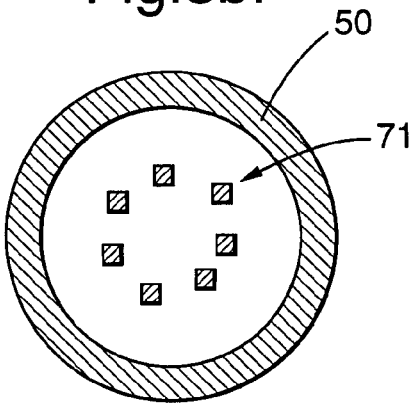
FIGS. 3*b* and 3*c* show a top view of the plate (10) of FIG. 3*a*, wherein the tines or bristles (71) are organized in two different possible configurations upon the containment zone.
Figure 3C:
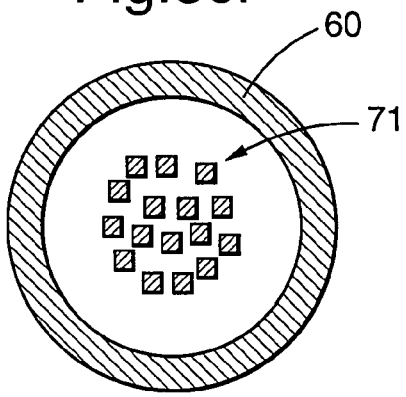

In embodiments wherein a plurality of tines extend upon the containment zone (70), the hair treatment composition may be applied upon the containment zone (70) within the perimeter created by the tines as shown in FIG. 3*b* or directly over the tines as shown in FIG. 3*c* of one plate. The presence and distribution of the tines in the containment zone (70) help the user to identify the volume of hair treatment composition to be applied on the application tool (1). In embodiments where the containment zone (70) is a groove in the plate or a cavity of the plate as shown in FIG. 5, the hair treatment composition may be loaded into the groove or in the cavity.

Any of the above described method of applying the hair treatment composition into the application tool (1) can be either performed manually or by mechanically operated machines, especially when the loading is executed during manufacture of the application tool (1). One or more methods may be employed either simultaneously or subsequently one to another.

The amount of hair treatment composition applied on the application tool (1) depends upon the application tool's (1) size and capacity, upon the fluid characteristics of the hair treatment composition and the desired end results. The application tool (1) may be preferably loaded with an amount of hair treatment composition from about 0.5 gram to about 120 grams, more preferably from about 1 gram to about 50 grams, even more preferably from about 1.5 grams to about 25 grams of hair treatment composition.

In one preferred embodiment of the application tool (1) of the invention, wherein said application tool (1) comprises an absorbent material which extends upon the containment zone (70) and upon the fluid control zone (50) of both plates (10; 20), a first hair treatment composition is loaded in the containment zone (70) of the first plate (10) and a second hair treatment composition is loaded in the containment zone (70) of the second plate (20). Preferably, said first hair treatment composition comprises an oxidizing agent and said second composition comprises an alkalizing agent. More preferably the oxidizing agent of said first hair treatment composition comprises hydrogen peroxide.

The hair treatment composition may be loaded before or after joining the materials to the fluid control (50) and containment (70) zones to the application tool (1). For those methods that could alter or inactivate the hair treatment composition, the materials are loaded, coated or charged after they have been joined to the application tool (1). Preferably the hair treatment composition is loaded prior to use by the user.

6. Method of Use

The present invention also relates to a method to treat the hair. The application tool (1) according to the present invention may be pre-loaded or consumer self-loaded. Preferably, the application tool (1) is loaded with a hair treatment composition as described herein. The user holds through the external surfaces (102; 202) of said first and second plates (10; 20) the application tool (1) in one hand, preferably between the thumb and the index finger. Once the user has selected the hair strands to be treated, the application tool (1) is positioned onto the hair strands, preferably at the root line while the application tool (1) is in an open state. The hair strand is then clamped between the internal surfaces (101; 201) of the application tool (1) by bringing the plates (10; 20) into a juxtaposed relationship. The user then applies the hair treatment composition by swiping the application tool (1) in a closed state along the entire length of the selected hair strands. The hair treatment composition may also be applied only to limited areas of the hair, i.e. the user can coat only the root-line with the hair treatment composition. These steps, including the step of loading the application tool (1) may be repeated more than once.

The hair treatment composition to be applied with the application tool (1) is selected from the group consisting of styling compositions, hair colourant composition, highlighting composition and combination thereof.

In certain embodiments, a first hair treatment composition is applied onto the zones of the internal surface (101) of the first plate (10) and a second hair treatment composition is applied onto the zones of the internal surface (201) of the second plate (20). Preferably, the first hair treatment composition is a composition comprising an alkalizing agent, wherein the second hair treatment composition is a composition comprising an oxidizing agent preferably hydrogen peroxide. The plates (10; 20) may be brought into juxtaposed position once, preferably twice, more preferably more than twice, before selecting a hair strand. This is necessary to mix the first and the second hair treatment compositions, particularly when the first and second hair treatment compositions must be mixed to react before being applied onto the hair strand. Mixing of a first composition comprising an alkalizing agent and a second composition comprising an oxidising agent creates a highlighting composition. In certain embodiments, mixing can be obtained by applying a force on the external surface of both plates so that they swing by a certain degree with respect to their fulcrum. By pressing the two plates (10; 20) against each other, displacement of the hair treatment composition from the zone where it is applied to the other zones of the same plate and of the opposite plate is achieved thus, mixing the hair treatment compositions. The mixing step can be performed prior or during application of the hair treatment composition to the hair strand as many times as needed to evenly mix the hair treatment compositions before to proceed with the application on the hair strand.

In another embodiment a first composition is applied to the hair via any of the known conventional methods as a pre- or post-treatment to a second composition and any further composition which can be applied via the application tool (1) according to the present invention.

In a preferred embodiment a first and a second hair treatment compositions are mixed together to form a third hair treatment composition. Said first and second hair treatment compositions are mixed in a vessel such as a bottle or tray. Once the third hair treatment composition is formed said third hair treatment composition is loaded onto the containment zone (70) of a least one plate (10) of said application tool (1). Preferably, said first hair treatment composition comprises an oxidizing agent and said second hair treatment composition comprises an alkalizing agent. More preferably, said oxidizing agent comprises hydrogen peroxide and said alkalizing agent comprises a component selected from the group of ammonium persulfate, sodium persulfate, potassium persulfate, sodium metasilicate, solidum silicate, ammonium chloride and mixtures thereof.

In one embodiment an absorbent material extends upon the fluid control zone (50) and the containment zones (70) of the first (10) and the second (20) plates. A hydrogen peroxide based composition is applied on the absorbent material which extends upon the containment zone (70) of both plates (10; 20), whereas an alkaliser is applied on the absorbent material on the second plate. When the hydrogen peroxide and the alkaliser compositions are mixed together they form a highlighting composition.

The application tools (1) according to the present invention are not intended to apply the hair treatment compositions in a stationary manner but rather they are moved against the hair surface with the use of shear forces, i.e., swiping of individual hair strands, rubbing along root-line, rubbing into hair, wiping surface of hair, pulled through hair etc., thereby depositing the hair treatment composition evenly along the entire length of the hair as required.

In embodiments where a liner is present, the user peels off the liner, if necessary loads the application tool (1) and applies the hair treatment composition to the hair. During the application one or more liners can be resealed to protect the application tool (1) and the hair treatment compositions or to avoid contamination of the user's home furniture with the hair treatment composition. In embodiments when the application tool (1) are pre-loaded by the manufactures and then sealed with liners, the user removes the liners before application of the hair treatment compositions. Once the liners have been removed, the user can either proceed to use or apply additional hair treatment compositions by loading them onto the application tool (1) as described above.

In embodiments where a reservoir (80) is present, the user may load the hair treatment composition through any of the dispensing means and then the user may remove liners or barriers before applying the hair treatment composition to the hair. The user may further apply other hair treatment compositions into the zones (50; 60; 70) of the application tool (1). The user may mix the hair treatment compositions before proceeding with the application by pressing the reservoir (80) and pushing the hair treatment composition contained therein to flow to the zones (50; 60; 70) all the way through the apertures (82) located through the plate (10, 20).

Finally, the application of the hair treatment composition may occur on wet or dry hair and optionally, a rinsing or a shampooing step can be included between application of the first and second compositions to the hair.

7. Kits

At least one application tool (1) according to the present invention may be provided as a component of a kit. Alternatively, more than one application tool (1) may be provided as component of the kit according to the present invention. Kit may comprise at least one or more individually packaged hair treatment compositions comprising shampoo compositions, conditioning compositions, styling compositions, hair colourant compositions, hair bleaching, highlighting compositions or combination thereof. In one embodiment of the present invention, a first container may comprise an oxidative dye precursors and an alkalizing agent whereas a second container may comprise an oxidizing agent. In certain other embodiments of kit, a first container may comprise an ammonium ion source and a second container may comprise an oxidizing agent. Additional containers may be present in the kit, such as individually packaged composition comprising additional components such as oxidising agents, conditioners, chelants, radical scavengers, solvents, direct dyes, shampoo, buffering agents, colouring agents thickeners, enzymes, anionic, non ionic, amphoteric and cationic surfactants, carriers, antioxidants, stabilizers, perfumes, masking fragrances, herb and plant extracts, pearlescent, opacifiers, hair swelling agents and/or polymers, humectants, moisturizers, viscosity enhancers, gelling agents, chelators, UV filters, antimicrobials, preservatives, proteins or mixtures thereof.

The kit according to the present invention may further comprise additional components such as means to select the hair strands, means to load the application tool (1) according to the present invention, means to mix the hair treatment compositions, combs or brushes, gloves, caps with holes, tweezers, tongues, hooks or combination thereof.

In another embodiment the kit further comprises an individually packaged composition comprising an oxidizing agent and an individually packaged composition comprising an alkalizing agent. Preferably said oxidizing agent is hydrogen peroxide. More preferably, at least one of said individually packaged hair treatment composition comprises a persulfate salt.

In certain embodiments, when the materials which extend upon said zones are removably attached to the fluid control (50) and containment (70) zones, said materials or replacements thereof may be comprised in the kit. The application tool (1) according to the present invention may be provided unassembled in the kit and instruction how to build the application tool (10) of the present invention may be further provided in the kit described above. The kit comprising the application tool (1) according to the present invention may further comprise instructions for consumers indicating how to load and/or use the application tools (1), said instruction being recorded in any type of media such as the package of the kit itself, paper material, compact disk, DVD or the application tool (1) itself.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An application tool for one or more hair treatment compositions, said application tool comprising a first plate and a second plate coupled together via a connection, each of said plates comprising an internal and external surface and each of said plates having a perimeter edge, wherein said plates are capable of supporting said one or more hair treatment compositions, wherein said internal surface of at least one plate comprises:

a fluid control zone, which runs along said perimeter edge of said at least one plate;

a displacement zone; and a containment zone;

wherein a material selected from the group consisting of a non-porous compressible material, an absorbent material, at least one bristle, at least one tine, and combinations thereof extends upon at least a portion of said fluid control zone;

wherein said fluid control zone and said containment zone are at least partially separated from one another by said displacement zone;

wherein said one or more hair treatment compositions is forced to move from said containment zone to said displacement zone toward said fluid containment zone when said application tool is loaded with said one or more hair treatment compositions, when said application tool is in a closed state, and when said plates are in a juxtaposed relationship;

wherein said containment zone comprises a perimeter and said displacement zone extends entirely around said perimeter of said containment zone;

wherein the connection comprises a spring back pressure to open of from about 0.01N/cm$^2$ to about 30.0 N/cm$^2$; and wherein when the application tool is in an open state, the angle between said internal surfaces of said first and second plates is from about 30° to about 185°.

2. An application tool according to claim 1, wherein said first and said second plates are connected via a hinge.

3. An application tool according to claim 1, wherein said material which extends upon at least a portion of said fluid control zone of said at least one plate is continuous.

4. An application tool according to claim 1, wherein said material selected from the group consisting of a non-porous compressible material, an absorbent material, at least one bristle, at least one tine, or a combination thereof extends upon at least a portion of said containment zone of said at least one plate.

5. An application tool according to claim 1, wherein said containment zone of said at least one plate is a groove formed in said internal surface of at least one plate.

6. An application tool according to claim 1, wherein said containment zone of said at least one plate is a cavity of said at least one plate.

7. An application tool according to claim 1, wherein a material extends upon at least a portion of said fluid containment zone, wherein said material is an absorbent substrate and said material which extends upon at least a portion of said fluid control zone is also an absorbent material.

8. An application tool according to claim 1, wherein said application tool further comprises a reservoir for said one or more hair treatment compositions, wherein said reservoir is in fluid communication with said containment zone.

9. An application tool according to claim 1, wherein said application tool further comprises a reservoir for said one or more hair treatment compositions, wherein said reservoir is in fluid communication with said displacement zone.

10. An application tool according to claim 1, wherein said application tool further comprises a reservoir for said one or more hair treatment compositions, wherein said reservoir is in fluid communication with said displacement zone and said containment zone.

11. A method of treating the hair with the application tool of claim 1 comprising the steps of:

loading said one or more hair treatment compositions onto said first and second plates of said application tool, bringing said first and said second plates of said application tool into a juxtaposed relationship at least once, contacting said plates with the hair; and applying said one or more hair treatment composition to the hair along the entire length of the hair.

12. The method of claim 11, wherein the internal surface of said first plate comprises a containment zone and the internal surface of said second plate comprises a containment zone, wherein said one or more hair treatment compositions comprise a first and a second hair treatment composition, and wherein said first hair treatment composition is loaded onto the containment zone of said first plate and said second hair treatment composition is loaded onto the containment zone of said second plate.

13. A method of treating the hair with the application tool of claim 1 wherein said one or more hair treatment compositions comprise a first and a second hair treatment composition, and wherein said method comprises the steps of:

Mixing said first and second hair treatment composition to form a third hair treatment composition;

loading said third hair treatment compositions onto the first and second plates of said application tool, contacting said plates with the hair; and applying said third hair treatment composition to the hair along the entire length of the hair.

14. The method of claim 11, wherein said one or more hair treatment compositions is selected from the group consisting of styling compositions, hair colourant compositions, highlighting compositions, and combinations thereof.

15. A kit comprising at least one application tool according to claim 1 and one or more individually packaged hair treatment compositions, wherein said one or more hair treatment compositions is selected from the group consisting of a shampoo composition, a conditioning composition, a styling composition, a hair colourant composition, a hair bleaching composition, a highlighting composition, and combinations thereof.

16. A kit comprising at least one application tool according to claim 1, an individually packaged hair treatment composition comprising an oxidizing agent, and an individually packaged hair treatment composition comprising an alkalizing agent, wherein at least one of said individually packaged hair treatment compositions comprises a persulfate salt.

17. The kit of claim 16 further comprising instructions indicating how to load said one or more individually packaged hair treatment compositions onto said application tool and how to use said application tool.

* * * * *